United States Patent [19]

Doudet

[11] Patent Number: 4,522,052

[45] Date of Patent: Jun. 11, 1985

[54] PROCESSES AND DEVICES FOR THE DRAWING OF TUBES BY EXTRUSION

[75] Inventor: Michel Doudet, Epone, France

[73] Assignee: Clecim, Courbevoie, France

[21] Appl. No.: 510,096

[22] Filed: Jul. 1, 1983

[30] Foreign Application Priority Data

Jul. 1, 1982 [FR] France ..... 82 11573

[51] Int. Cl.[3] ..... B21C 27/00; B21C 35/06

[52] U.S. Cl. ..... 72/265; 72/273.5

[58] Field of Search ..... 72/263, 265, 273.5, 72/255, 256

[56] References Cited

U.S. PATENT DOCUMENTS

| | | | |
|---|---|---|---|
| 3,370,449 | 2/1968 | Lomas | 72/263 |
| 3,528,275 | 9/1970 | Sibler | 72/256 |
| 3,738,144 | 6/1973 | Doudet | 72/255 |
| 4,345,450 | 8/1982 | Doudet | 72/265 |
| 4,365,497 | 12/1982 | Asari | 72/263 |
| 4,399,676 | 8/1983 | Noyori et al. | 72/265 |
| 4,424,696 | 1/1984 | Asari et al. | 72/273.5 |

*Primary Examiner*—W. D. Bray

*Attorney, Agent, or Firm*—Pollock, Vande Sande & Priddy

[57] ABSTRACT

A process and device for drawing tubes by extrusion of a metal billet (4) placed in a receptacle (50) within which ramming of the billet (4) is carried out by first pushing the latter against a ramming insert (63) closing the receptacle (50), then perforating the billet by means of an axial mandrel (7), and finally replacing the ramming insert (63) in the axis of the receptacle (50) by an insert (65) holding a die. Drawing is carried out by extrusion of the billet. During ramming of the billet (4), a boss (41) is formed on the face of the latter turned towards the ramming insert (63) which is inscribed within an orifice (66) in the die and which has a plane face centered on an axis diverging from the drawing axis. The ramming insert (63) is provided for this purpose with an impression (8) which has recessed the desired shape. During perforation of the billet (4), the advance of the mandrel (7) is blocked before it reaches the bottom of the dish (8) so as not to perforate the boss (41), and, after the ramming insert (63) has been replaced by the die-holder insert (65), the mandrel (7) is advanced in the die, detaching the boss (41) without carrying along the bottom of the latter, which remains attached by one edge (42) to the billet (4) because of its offset in relation to the mandrel.

6 Claims, 13 Drawing Figures

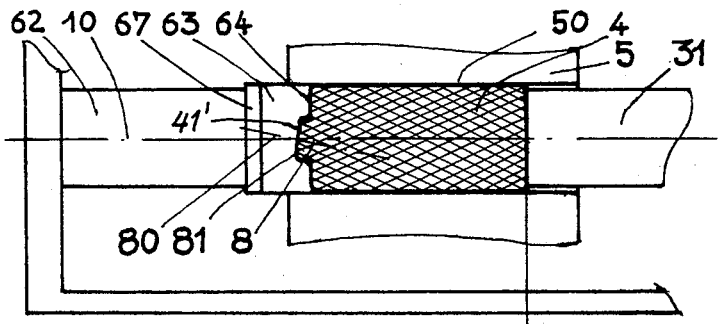
Fig 1
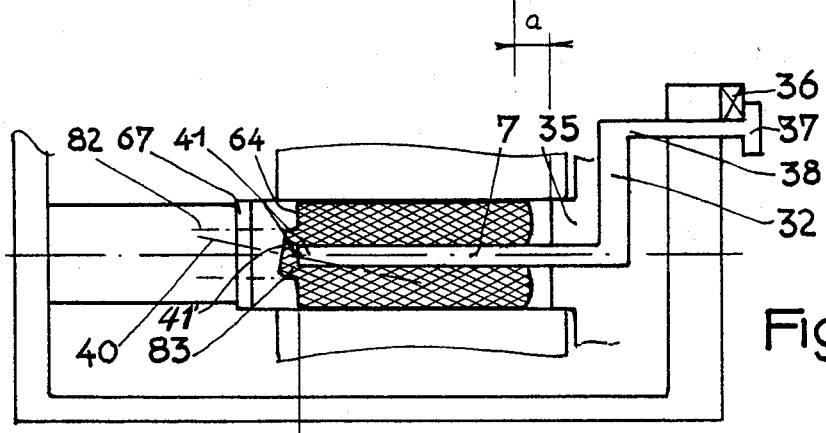
Fig 2
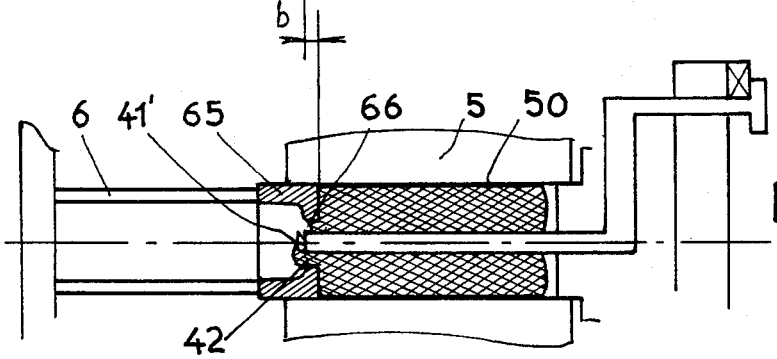
Fig 3
Fig 10
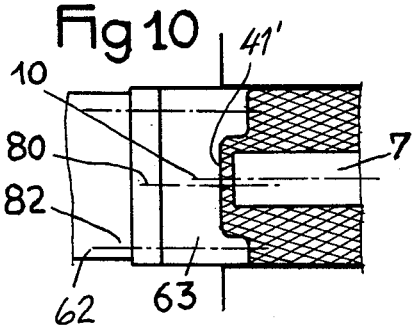
Fig 11
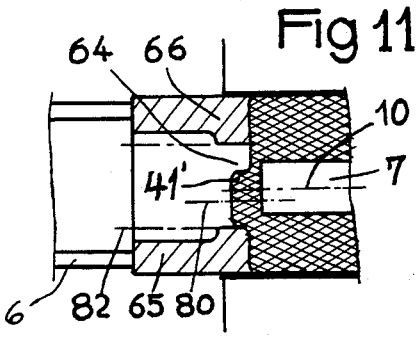

PROCESSES AND DEVICES FOR THE DRAWING OF TUBES BY EXTRUSION

FIELD OF THE INVENTION

The invention relates to a process for the drawing of tubes by extrusion of a metal billet and also covers a device for putting the process into practice.

BACKGROUND OF THE INVENTION

It is known that the drawing of tubes by extrusion of a metal billet is carried out in an hydraulic press, the ingot or billet of cylindrical shape being placed in a receptacle of the same cross-section provided inside a container; the billet is pushed by a hydraulic jack against a die, within which a coaxial mandrel makes an annular space for formation of the tube. In so-called direct-drawing presses, the container is fixed and the billet is pushed against the die which closes the front face of the receptacle of the container by means of a rammer which penetrates via the rear face of the receptacle and which consists of a rod provided at its end with a thrust insert, the diameter of which is equal to that of the receptacle.

In so-called reverse-drawing presses, the rammer is fixed and consists of a tube provided at its end with an insert having a diameter equal to that of the receptacle of the container and carrying the die. The receptacle of the container is closed at its other end by a shutter, and the assembly is displaced towards the rammer in such a way that the latter slips into the receptacle for the billet. For the drawing of a tube, the shutter is perforated with an orifice through which passes the mandrel which penetrates through the billet and slips into the die.

The drawing press will therefore consist essentially of a fixed part comprising a bed and a fixed cross-member, which are spaced from one another and connected by columns, and of a movable part comprising a movable cross-member which is actuated by a main jack bearing on the bed and on which the container is supported.

Whether drawing is carried out directly or in reverse, a mandrel, the end of which penetrates into the die, must always pass through the billet. It is possible to use pre-perforated billets, i.e., those provided beforehand with an axial duct in which the mandrel can pass, but generally it is preferable to perforate the billet once it has been placed in its receptacle.

Consequently, the conventional sequence of operations will be as follows:

When the billet has been placed inside the receptacle of the container closed at one end by the die-holder insert, the billet is first rammed within its receptacle by pushing it against the die by means of the movable rammer in direct drawing or by means of a special stop in reverse drawing. The purpose of this operation is to apply the billet against the walls of the receptacle and make it adhere to them.

Perforation is then carried out by advancing the mandrel which passes axially through the billet. If the advance of the mandrel is stopped before it has emerged in the die on the other side of the billet, the axial orifice remains closed by a metal partition of small thickness which remains at the end of the tube which is formed by drawing and in which a vacuum is therefore generated. The atmospheric pressure acting on the outside of the drawn tube tends to crush and deform the latter which can be flattened completely if it is of small thickness.

Consequently, it is generally preferable to perforate the billet completely before drawing, by advancing the mandrel during perforation until it penetrates within the die. The result of this is that the end of the mandrel causes a small piece of metal, called a plug, corresponding to the partition which previously closed the end of the tube, to drop into the die. The presence of this plug is particularly annoying in reverse drawing, since it then falls inside the tubular rammer and is difficult to remove.

OBJECT OF THE INVENTION

The object of the invention is an improvement to drawing processes which makes it possible to avoid this disadvantage. Although it can also be used in direct drawing, the invention is especially useful for reverse drawing, and consequently the following description will be limited to the description of a press of this type which is provided with improvements allowing the process to be put into practice

SUMMARY OF THE INVENTION

According to the invention, during the ramming of the billet, there forms on the face of the latter turned towards the ramming insert a boss which is inscribed within the orifice of the die and which has a front face centered on an axis not coinciding with the axis of the die, the ramming insert being provided for this purpose with an impression which has recessed the desired shape. During the perforation of the billet, the advance of the mandrel is blocked before it reaches the bottom of the dish, so that it does not perforate the boss, and, after the ramming insert has been replaced by the die-holder insert, the mandrel is advanced into the die, detaching the boss, without carrying along the front face of the latter, which remains attached by one edge to the billet because it is offset in relation to the mandrel.

Preferably, the ramming insert is made to penetrate into the receptacle of the container over an adjustable distance less than the penetration of the die-holder insert, and, after perforation has been carried out by advancing the mandrel up to a blocking wedge, the container together with the mandrel is retracted so as to release the ramming insert and replace it with the die-holder insert, the container, together with the blocked mandrel, then being advanced, the difference in penetration of the insert determining the detachment of the boss.

The invention also covers drawing devices for putting the process into practice, wherein the ramming insert is provided, on its face turned towards the billet, with an impression in the form of a circular dish with a flat bottom, the axis of which does not coincide with the drawing axis and the periphery of which is inscribed within a cylinder centered on the said drawing axis and having a diameter equal to that of the die.

In a first embodiment, the bottom of the dish is located in a plane slightly inclined relative to the drawing axis.

In another embodiment, the axis of the bottom of the dish is parallel to the drawing axis and offset laterally in relation to the latter, the periphery of the dish having a diameter less than that of the die by a value at most equal to the variation between the axes.

Furthermore, in a preferred embodiment, the ramming insert penetrates into the receptacle of the container over a distance which is shorter than the die-holder insert and greater than the distance existing between the end of the needle and the bottom of the boss at the end of the perforation.

The invention will be understood better from the following description of a particular embodiment and of several alternative forms, with reference to the attached drawings.

BRIEF DESCRIPTION OF THE DRAWINGS

FIGS. 1, 2 and 3 show diagrammatically the various phases of the improved process according to the invention.

FIGS. 10 and 11 show diagrammatically two alternative embodiments of the invention.

FIG. 4 illustrates, in longitudinal section, an entire reverse-drawing press of conventional type.

DETAILED DESCRIPTION

Figure 4:
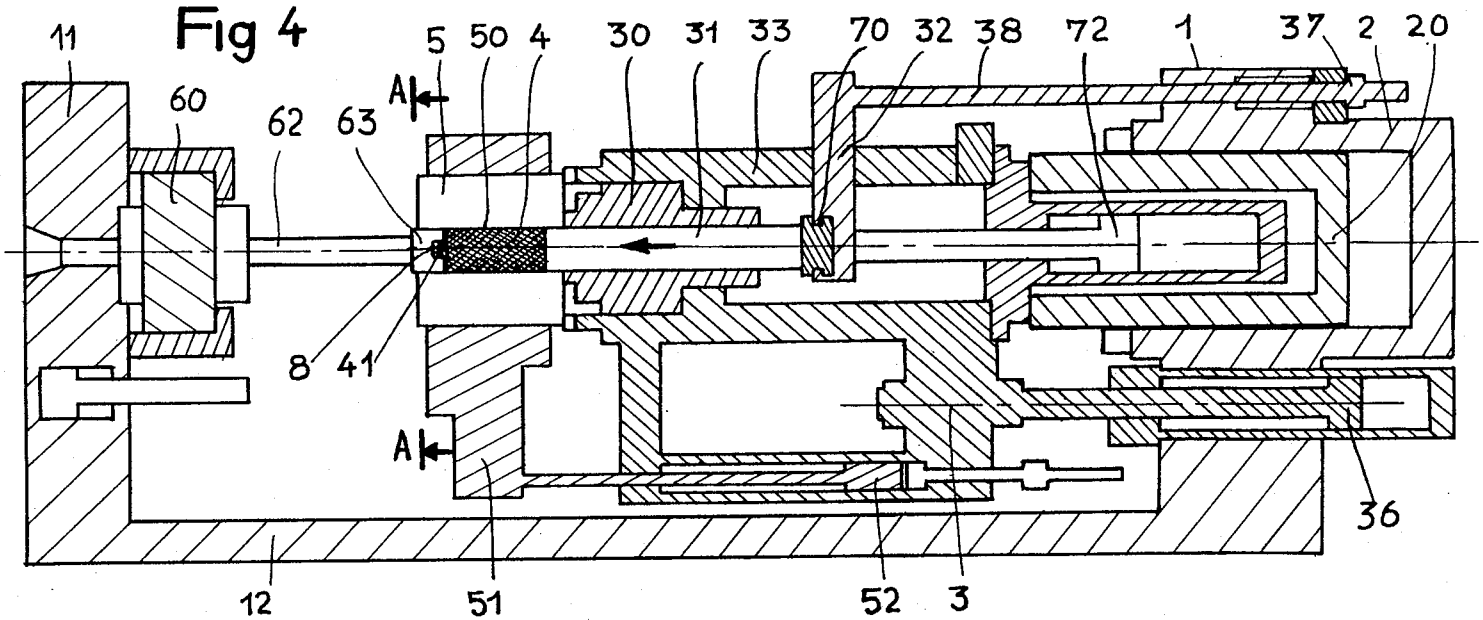
FIG. 4 is a general view, in a longitudinal section along the drawing axis, of a reverse-drawing press in the billet-ramming position.

The fixed part of the press comprises a bed 1 and a fixed cross-member 11 which are maintained at a distance from one another by columns 12. The bed 1 carries the body of a main drawing jack 2, the piston 20 of which actuates a movable cross-member 3. The billet 4 is placed in a receptacle 50 provided in a container 5 which is itself fastened to a container-carrying cross-member 51.

Since the movements of the main jack 2 are slow, the movable cross-member 3 can be actuated by jacks 36 which bear on the bed 1. The same is true of the container-carrying cross-member 51 which can be actuated, independently of the movable cross-member, by jacks 52. In the example illustrated in the drawings, the jacks 52 for actuating the container 5 are carried by the movable cross-member 3 according to a known arrangement which is the subject of applicant's French Pat. No. 2,196,860.

Figure 9B:
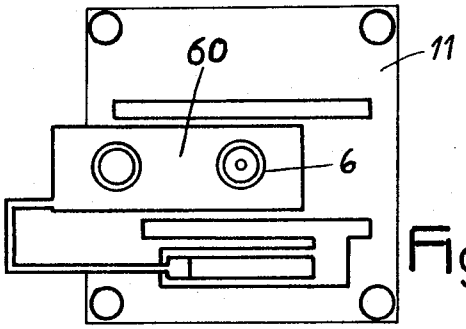
FIGS. 9*a* and 9*b* show diagrammatically two positions of the slide in a cross-section along line A—A in FIG. 4.
Figure 9A:
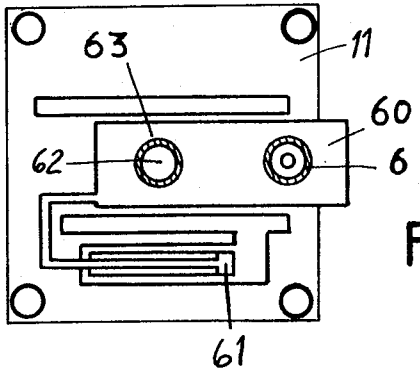
Figure 4A:
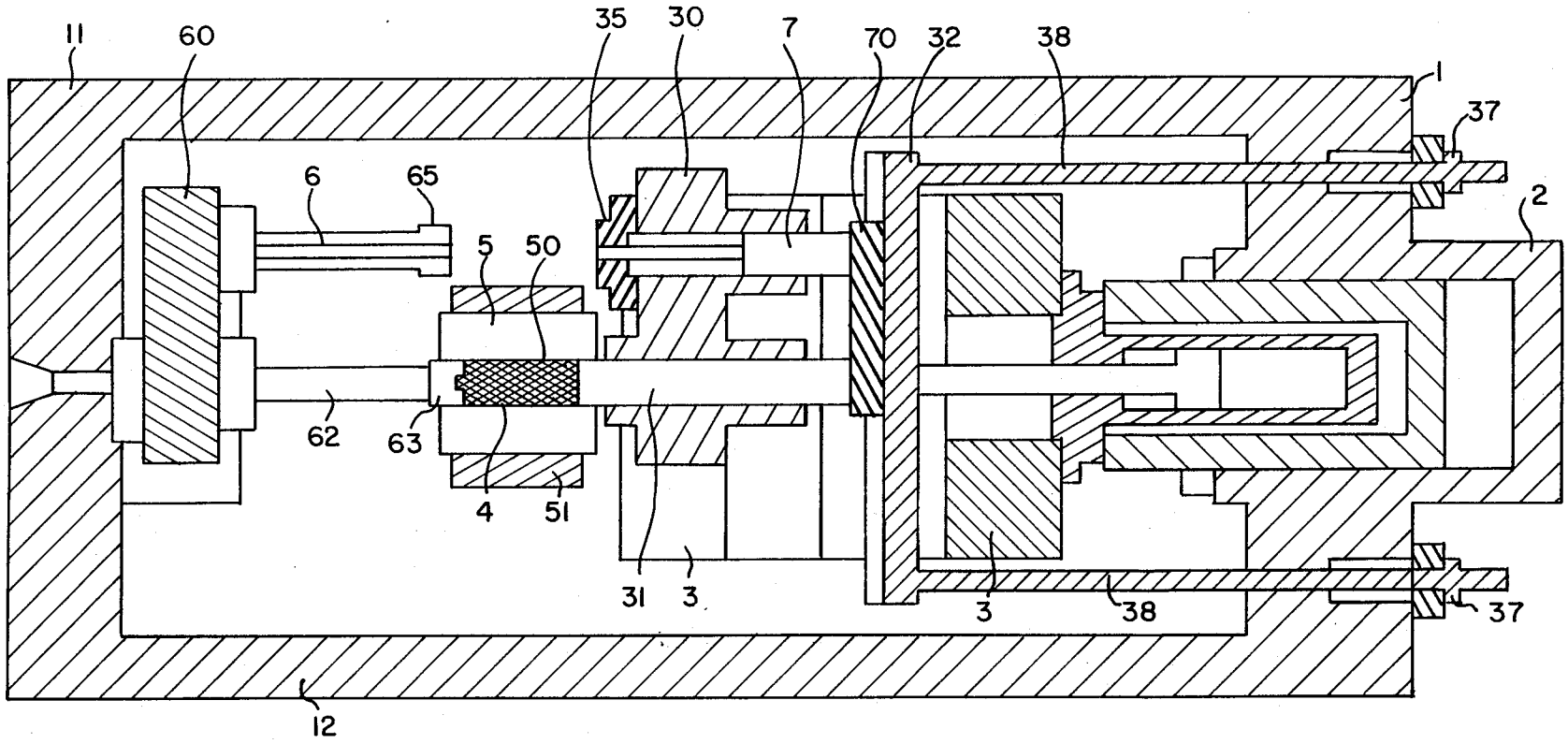
FIG. 4*a* is a plan view similar to FIG. 4 showing details of the positioning of the mandrel and the loading rod in further detail.
Figure 5:
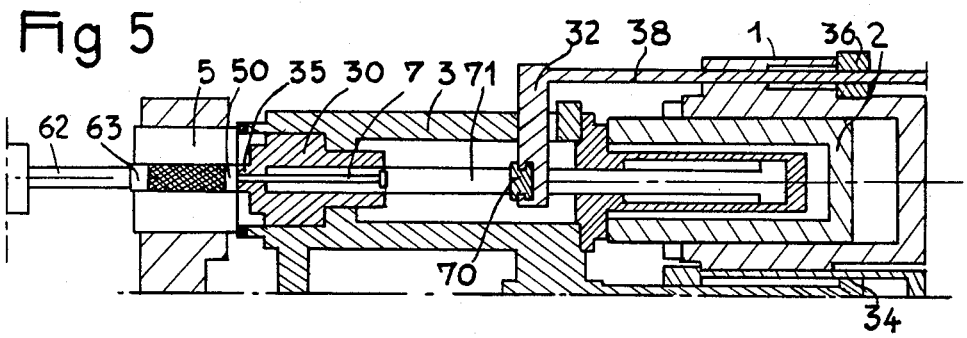
FIGS. 5 to 8 are partial views, in longitudinal section, of the various phases of a drawing operation carried out according to the invention.
Figure 6:
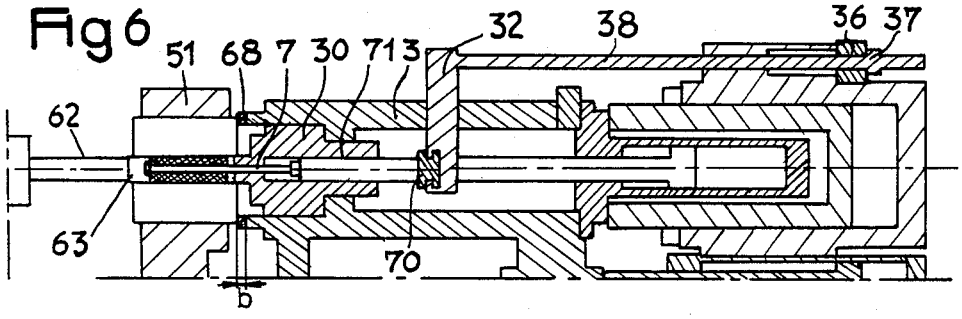

It has been mentioned that, during drawing, the receptacle 50 for the billet must be closed by a shutter 35 fixed to the movable cross-member. On the other hand, before drawing, it is necessary to carry out ramming of the billet. Consequently, according to an arrangement which is likewise known, the shutter 35 and the rammer 6 are each provided on a slide 30 and 60, respectively, displaceable transversely to the drawing axis. FIGS. 9*a* and 9*b* show, for example, the slide 60 carrying the rammer 6 in a front view according to Section A—A in FIG. 4. The slide 60 actuated by a jack 61 can thus assume two positions which allow it to move into the drawing axis either the tubular drawing rammer 6 or an auxiliary scraping rammer 62 carrying at its end a scraping insert 63 which acts as a support for ramming the billet. In fact, at the end of the drawing, there is, along the wall of the receptacle 50, a thin metal sleeve which corresponds to the clearance which must exist between the die-holder insert and the receptacle of the container. At the end of drawing, in order to remove this sleeve, it is customary first to retract the container 5 so as to release the rammer 6 and then to replace the die-holder insert with a scraping insert 63, the diameter of which is exactly equal to that of the receptacle of the container. The sleeve can therefore be expelled by advancing the container 5 again so that it slips over the scraping rammer 62. It is possible, of course, to place the scraping insert 63 at the end of the tubular rammer 6 serving for drawing, but it is more advantageous, as shown in the drawing, to use two rammers, one (6) for drawing and the other (61) for scraping, which are offset laterally and can be moved into the drawing axis alternately by means of the slide 60 actuated by the jack 61.

When the receptacle 50 of the container has been scraped in this way, it must be loaded with a new billet, and, according to a known arrangement, this operation is advantageously carried out by means of the slide 30 which carries the shutter 35 of the container and on which is placed a loading receptacle which, as a result of the transverse displacement of the slide, can move into the drawing axis at the rear of the container 5. The billet is then introduced into the container preferably by means of a rod 31 which is displaceable along the drawing axis. Thus, the slide 30 makes it possible to place in the drawing axis either the shutter 35 of the receptacle 50 of the container or the loading receptacle and the loading rod 31. Moreover, it is advantageous to displace, together with the slide, the tube-drawing mandrel 7, and consequently, according to an arrangement which is the subject of applicant's French Pat. No. 2,360,359 the mandrel 7 is mounted on a supporting rod 71 fastened in its rear part to an auxiliary slide 70 which is displaced synchronously with the slide 30 on an auxiliary cross-member 32 which is fixed to the movable cross-member 3 and which likewise carries the loading rod 31. The assembly can be displaced axially under the action of a single jack 72 provided, for example, within the piston 20 of the main jack.

Thus, after the receptacle has been scraped and the new billet 4 has been brought opposite the latter by means of the slide 30, the billet is introduced into the receptacle by means of the rod 31 actuated by the jack 72. It is then possible to continue to advance the rod 31 to carry out the ramming of the billet within its receptacle if the rod 31 is given the diameter of the container. The loading rod 31 then acts as a rammer in the same way as the scraping insert 63, which has remained attached at the end of the receptacle 50, acts as a ramming insert.

The principle of the invention is shown diagrammatically in FIGS. 1, 2 and 3. Only the essential components involved in putting the invention into practice are shown, on an enlarged scale.

FIG. 1 illustrates the operation of ramming the billet 4 within its receptacle 50 closed by the insert 63 located at the end of the scraping rammer 61, ramming being carried out by the rod 31. According to the essential characteristic of the invention, the insert 63 is provided, in the central part of its face 64 turned towards the billet, with an impression 8 in the form of a circular dish with a flat bottom, the axis 80 of which does not coincide with the drawing axis 10. In the example illustrated, the center of the bottom 81 of the dish is located on the drawing axis 10, but the axis 80 of the bottom of the dish is inclined in relation to the drawing axis 10. The result of this is that the ramming of the billet forms on the face of the latter a boss 41 of projecting shape corresponding to that of the dish 8.

After ramming, the jack 72 retracts the rod 31 so as to release it from the receptacle 50, and the slides 30 and 70 actuated simultaneously place the shutter 35 and the mandrel 7 in the drawing axis. The jacks 52 for actuating the container, which bear on the movable cross-member, make it possible, if appropriate, to displace the latter, while leaving the container fixed, in order to adjust the penetration of the shutter 35 within the receptacle 50 for the billet. In particular, the shutter 35 must penetrate within the receptacle 50 over a shorter distance than the ramming rod 31, so as to leave at the rear of the billet 4 a free space of width (a) allowing the billet to be elongated at the moment of perforation. This is carried out by means of the mandrel 7 actuated by the jack 72. However, the length by which the mandrel advances for perforation is adjusted by a shim 36 interposed between the bed 1 and a stop 37 provided on a rod 38 fixed to the auxiliary cross-member 32, the assembly being shown diagramatically in FIGS. 2 and 3. The thickness of the shim 36 is calculated so that the front end of the mandrel arrives substantially in the plane of the face 64 of the ramming insert at the end of perforation. According to another characteristic, the periphery 83 of the dish is inscribed within a cylinder 82 centered on the drawing axis 10 and of a diameter equal to that of the die and consequently greater than that of the mandrel 7. The result is that, at the end of perforation, as can be seen in FIG. 2, the end of the mandrel 7 does not perforate the boss 41 which was formed in the dish 8 by the preceding ramming operation. The boss 41 thus constitutes a plug in front of the end of the mandrel 7.

The assembly consisting of the container 5 and the movable cross-member 3 can then be retracted so as to release the ramming insert 63 which is moved away laterally, together with the rammer 61, by means of the slide 60, the tubular rammer 6 then moving into the drawing axis in the position shown in FIG. 3, with the die-holder insert 65 at its end. The container 5 and the movable cross-member 3 are then advanced again, and the boss 41 advances into the die 66, since, as noted, the latter has a diameter at least equal to that of the periphery of the boss 41. On the other hand, the penetration of the die-holder insert 65 within the receptacle 50 is greater than the penetration of the ramming insert 63, and the difference (b) can be adjusted, for example, by means of a shim 67 located at the end of the scraping rammer 62 between the latter and the insert 63.

Consequently, when the container 5 slips over the die-holder insert 65, the billet 4 is stopped by the die-holder insert 65, before the stop 37 comes up against the bed 1 again, by means of the shim 36. When this contact is made, the mandrel 7 fixed to the movable cross-member 3 has therefore advanced in relation to the billet 4 over the same distance (b) and perforates the boss 41. However, the boss 41 has a shape in relief which is identical to that of the dish 8 of the ramming insert 63 and therefore has itself an axis 40 inclined relative to the drawing axis. This offset results in an asymmetry in the lateral thickness of the plug formed by the boss 41 which consequently gives way on the thinnest side when the mandrel 7 advances over the distance (b) in relation to the boss. The latter therefore opens on one side of the mandrel, but remains attached to the billet on its thickest side 42, as shown in FIG. 3. In this way, the plug 41 is prevented from falling into the tubular rammer 6 at full perforation. When drawing is carried out, the drawn tube is perforated at its front end, thus preventing it from being crushed by the atmospheric pressure, but the cap formed by the rest of the plug 41 at the front of the mandrel remains fixed to the end of the tube formed. It is therefore discharged from the rammer together with the tube, without the risk that it will remain within the tubular rammer.

The means making it possible to carry out the various phases which have just been described are illustrated in more detail in FIGS. 5 to 8 with regard to the press in FIG. 4.

As indicated, FIG. 4 illustrates the phase of ramming and forming the boss 41 within the dish 8 provided in the ramming insert 63. After this operation, the ramming rod 31 is retracted by the jack 72, and the transverse displacement of the slides 30 and 70 brings the shutter 35 and the mandrel 7 into the drawing axis, in the position shown in FIG. 5.

The auxiliary cross-member 32, to which the mandrel 7 is fastened, is then advanced until the stops 37 provided on the rods 38 bear on the bed 1 by means of the shims 36. In this position, shown in FIG. 6, the mandrel 7 does not perforate the boss 41.

Figure 7:
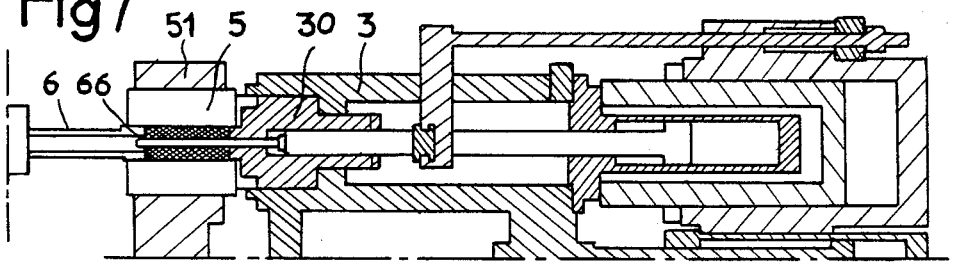

In the embodiment illustrated here, the rammer 62 and the drawing rammer 6 have been given the same length. In fact, the distance (b) corresponding to perforation of the boss can likewise be obtained by means of shims 68 placed between the movable cross-member 3 and the container-carrying cross-member 51. After perforation, the assembly consisting of the movable cross-member 3 and the container-carrying cross-member 51 is retracted the length necessary to release the scraping and ramming insert 63. The tubular rammer 6 can then be placed in the drawing axis, and the assembly consisting of the movable cross-member 3 and the container-carrying cross-member 51 can be advanced again. However, as shown in FIG. 7, the shims 68 of thickness (b) have been removed so that the mandrel penetrates the same distance into the boss 41 and opens it. The shim 36 is then removed, and the movable cross-member and the container are advanced so as to cause the mandrel to penetrate within the die over a length equal to the thickness of the shim 36. Of course, if desired, these two operations can be carried out at the same time, the shim 36 then performing the function of the shims 68. However, the use of a shim located between the movable cross-member and the container makes it possible to adjust the distance b with greater accuracy and open the boss 41 in a special operation which is easier to monitor.

Figure 8:
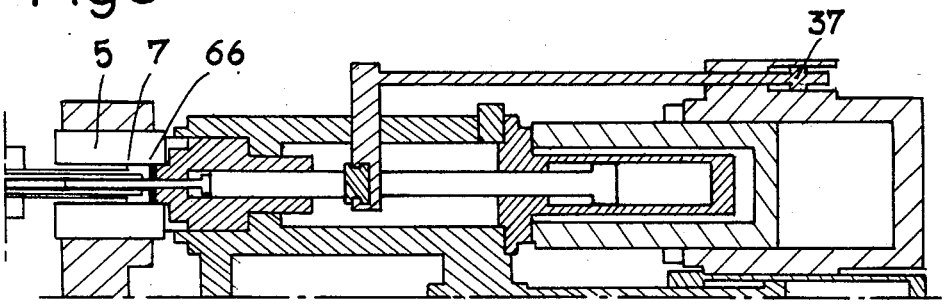

Drawing can be carried out in a conventional way by advancing the assembly consisting of the movable cross-member 3 and the container 5 in relation to the die 66 fastened to the rammer 6, the tube being formed between the mandrel 7 and the die 66. FIG. 8 shows the position of the press at the end of drawing. In this case, the technique of the attendant mandrel is used, the mandrel 7 being displaced with the movable cross-member 3 and consequently penetrating within the die 66 over a length corresponding to the length of the billet. It is then necessary, of course, as shown in FIG. 8, that the shims 37 fixed to the movable cross-member 3 should not remain blocked on the bed 1. However, it is also possible to adopt the technique of the stopped mandrel by making the shims 37 come up against the bed 1 at the end of the phase of penetration of the mandrel, i.e., after the shims 36 have been removed. The end of the mandrel then remains blocked within the die 66 without penetrating any further into the tubular rammer during the advance of the movable cross-member.

The improvements which have been described can apply, with the necessary modifications, to all types of reverse-drawing presses. Moreover, the process, the principle of which has been shown in FIGS. 1 to 3, applies likewise, as appropriate, to a direct-drawing press.

The invention can also embrace alternative forms, especially with regard to the production of the boss. As an example, in FIG. 10, the dish 8 made in the ramming insert 63 has an axis 80 parallel to the drawing axis 10, but offset laterally in relation to the latter. In this case, it is possible, at the moment of perforation, to advance the mandrel 7 until its end penetrates into the boss 41' formed in the dish 8. Because of the offset of the axes 10 and 80, the plug thus formed has an edge of less thickness on one side of the mandrel, and this will therefore give way first when the mandrel is advanced after the inserts 63 and 65 have been exchanged. However, since the boss 41' has to penetrate into the die, this embodiment is possible only for drawing relatively thick tubes, i.e., when there is a considerable difference in diameter between the mandrel 7 and the die 66. Otherwise, it is still possible to use the embodiment shown in FIG. 11, in which there is a boss 41', the axis of which is likewise parallel to the drawing axis 10 and is offset relative to the latter, but the periphery of which, while remaining inscribed within the cylinder 82 of diameter equal to that of the die, is less than this. The end of the mandrel 7 must in this case be stopped before it reaches the front face 64 of the ramming insert at the moment of perforation. Subsequently, when the ramming insert 63 has been replaced by the die-holder insert 65, it is possible to advance the mandrel 7 which detaches the boss 41' on one side only, the other side remaining fastened to the billet 4.

I claim:

1. Process for drawing tubes along a drawing axis (10) by extrusion of a metal billet (4) placed in a cylindrical receptacle (50) forming a container (5), including the steps of (a) ramming said billet (4) within said receptacle (50) by pushing said billet against a ramming insert (63) closing said receptacle forming a boss (41) on the face of said billet (4) opposite said ramming insert (63), said boss (41) being inscribed within an orifice (66) of said die and having a plane face centered on an axis angularly diverging from said drawing axis (10), said ramming insert (63) being provided for this purpose with an impression (8) in the form of a circular dish with a flat bottom which has recessed the desired shape;

(b) perforating said billet (4) by means of an axial mandrel (7) whose advance is blocked before it reaches said bottom of said dish (8) so that it does not perforate said boss (41);

(c) replacing said ramming insert (63) in the axis of said receptacle (50) by an insert (65) holding a die (66);

(d) said mandrel (7) having a diameter smaller than that of said die and advancing into the latter;

(e) detaching said boss (41) without carrying along the bottom of said die (66), which remains attached to said billet (4) by one edge because of its offset in relation to said mandrel (7).

2. Process as claimed in claim 1, wherein said ramming insert (63) penetrates into said receptacle (50) over an adjustable distance less than the penetration of said die-holder insert (65), and wherein, after perforation has been carried out by advancing said mandrel (7) up to a blocking shim (36), said container (5) together with said mandrel (7) is retracted so as to release said ramming insert (63) and replace it by said die-holder insert (65), and said container (5) together with said blocked mandrel (7) is then advanced, the difference (b) in penetration of said inserts (63 and 65) determining the detachment of said boss (41).

3. Device for drawing tubes along a drawing axis (10) by extrusion of a metal billet (4) in a die (66) by means of a press comprising a container (5), comprising (a) a cylindrical receptacle (50) for said billet (4) centered along said drawing axis (10);

(b) means (20) for pushing said billet (4) toward said one end of said container (5);

(c) means (60, 61) for selectively positioning, along said drawing axis (10), for the purpose of closing said receptacle (50), a solid insert (63), called a ramming insert, and an insert (65) holding said die (66);

(d) a mandrel (7) aligned with said drawing axis (10) and mounted on a support (32) displaceable parallel to said axis for perforating said billet (4) and then for drawing said tube, said mandrel advancing during drawing within said die (66) and along the axis of the latter;

(e) said ramming insert (63) being provided on its face (64) turned toward said billet (4) with an impression (8) in the form of a circular dish having a flat bottom, the axis (8) of which angularly diverges from said drawing axis (10) and the diameter of which is equal to that of said die (66).

4. A tube-drawing device as claimed in claim 3, wherein the bottom (81) of said dish (8) is placed in a plane slightly inclined in relation to the drawing axis (10).

5. A tube-drawing device as claimed in claim 3, wherein the axis (80) of said dish (8) is parallel to said drawing axis (10) and offset laterally in relation to the latter, the periphery of said dish (8) having a diameter less than that of said die (66) by a value at most equal to the variation between said axes (10, 80).

6. A tube-drawing device as claimed in any one of claims 3 to 5, wherein said ramming insert (63) penetrates into said receptacle (50) over a distance which is shorter than said die-holder insert (65) and greater than the distance between the end of said mandrel (7) and the bottom of said boss (41) at the conclusion of perforation.

* * * * *